US008844605B2

(12) United States Patent
Ng

(10) Patent No.: US 8,844,605 B2
(45) Date of Patent: Sep. 30, 2014

(54) SINGLE CORD OPERATED CLUTCH FOR ROLLER BLIND

(76) Inventor: Philip Ng, Thornhill (CA)

( * ) Notice: Subject to any disclaimer, the term of this patent is extended or adjusted under 35 U.S.C. 154(b) by 51 days.

(21) Appl. No.: 13/612,479

(22) Filed: Sep. 12, 2012

(65) Prior Publication Data

US 2014/0069596 A1 Mar. 13, 2014

(51) Int. Cl.
*E06B 9/56* (2006.01)

(52) U.S. Cl.
USPC ..... 160/319; 192/41 S; 192/81 C; 160/170

(58) Field of Classification Search
CPC ..... E06B 9/322
USPC ..... 160/319, 320, 313, 307, 308, 298, 299, 160/170, 168.1 R, 321; 192/41 S, 81 C
See application file for complete search history.

(56) References Cited

U.S. PATENT DOCUMENTS

| | | | | |
|---|---|---|---|---|
| 5,375,643 | A * | 12/1994 | Rude | 160/321 |
| 6,142,211 | A * | 11/2000 | Judkins | 160/308 |
| 7,128,126 | B2 * | 10/2006 | Smith et al. | 160/319 |
| 7,578,334 | B2 * | 8/2009 | Smith et al. | 160/319 |
| 7,665,507 | B2 * | 2/2010 | Naoki | 160/308 |
| 7,836,937 | B2 * | 11/2010 | Anderson et al. | 160/170 |
| 8,186,413 | B2 * | 5/2012 | Fujita et al. | 160/121.1 |
| 8,356,653 | B2 * | 1/2013 | Fu-Lai et al. | 160/84.05 |
| 2004/0226663 | A1 * | 11/2004 | Smith et al. | 160/84.05 |
| 2006/0272783 | A1 * | 12/2006 | Smith et al. | 160/121.1 |
| 2009/0308547 | A1 | 12/2009 | Kwak | |
| 2010/0065226 | A1 * | 3/2010 | Fraser et al. | 160/168.1 R |
| 2012/0048485 | A1 * | 3/2012 | Fu-Lai et al. | 160/331 |

OTHER PUBLICATIONS

Basic Design Principal, Warner Electric Publication, P-1310-WE Jan. 2011.

* cited by examiner

*Primary Examiner* — Katherine Mitchell
*Assistant Examiner* — Scott Denion
(74) *Attorney, Agent, or Firm* — Honigan Miller Schwartz and Cohn LLP

(57) ABSTRACT

A clutch for a roller blind. The clutch comprises a drive shaft operatively connected to a drive mechanism, an idle shaft releasably coupled to the drive shaft, and a drive spring. The drive mechanism imparts rotational movement to the drive shaft. The idle shaft is operatively connected to the tube of the roller blind such that rotation of the idle shaft causes rotation of the roller blind tube. The drive spring is operatively associated with the idle shaft and with the drive shaft such that rotation of the drive shaft in a first direction causes the drive spring to impart rotational movement to the idle shaft, thereby causing rotation of the roller blind tube. When the drive shaft is rotated in a second opposite direction the drive spring permits the drive shaft to rotate independently of the idle shaft.

6 Claims, 10 Drawing Sheets

SINGLE CORD OPERATED CLUTCH FOR ROLLER BLIND

FIELD

This invention relates to a single cord operated clutch for a roller blind or roller shade.

BACKGROUND

Roller blinds (or roller shades) are commonly used on windows, doors and other structures for aesthetic purposes and for noise and light control. Most roller blinds are constructed with a clutch mechanism that allows the blind fabric or material to be raised or lowered as desired. Most commonly, roller blinds are activated through a looped cord or chain, that when pulled in one direction results in blind fabric being unrolled from the blind roller while pulling in an opposite direction results in blind fabric being rolled back onto the roller. The cord or chain typically engages a clutch mechanism, which in turn drives the roller in one direction or the other. While such structures have met with a considerable amount of success and have been widely used in both commercial and residential applications, they can at times present unsightly elongate loops of cord or chain that hang downwardly from the upper end of the roller. In some instances a guide or tensioning wheel may be mounted to the structure adjacent to the blind in order to hold the cord or chain neatly in place. However, the mounting of such guides or tensioning wheels increases the labour involved in mounting a roller blind to a structure and often results in a necessity to drill holes and screw or otherwise fasten the guide or tensioning wheel in place. In addition to the aesthetic and cost aspects associated with the use of lengthy cords or chains, in some instances the relatively long looping cords or chains have been found to present strangulation hazards when used in areas frequented by small children and infants. The threat of potential strangulation has caused some jurisdictions to mandate the use of guides or tensioning rollers to help reduce the possibility of the chains or cords becoming wrapped around the neck of an infant or small child, particularly when the roller blind is used in a child's bedroom or nursery.

To address such problems, others (for example see US Patent Publication No. U2009/0308547, dated Dec. 17, 2009) have proposed the use of a clutch mechanism having a single, retractable cord. Such clutches avoid the use of long looping cords or chains. However, to date their structures have exhibited a tendency to cause wear on internal components and to be relatively noisy on account of the general use of a ratcheting-type clutch.

SUMMARY

The invention therefore provides in one of its aspects a clutch for a roller blind, the clutch comprising a drive shaft operatively connected to a drive mechanism, the drive mechanism imparting rotational movement to said drive shaft; an idle shaft releasably coupled to said drive shaft, said idle shaft operatively connected to the tube of the roller blind such that rotation of said idle shaft causes rotation of the roller blind tube; and a drive spring, said drive spring operatively associated with said idle shaft and with said drive shaft such that rotation of said drive shaft in a first direction causes said drive spring to impart rotational movement to said idle shaft thereby causing rotation of the roller blind tube, when said drive shaft is rotated in a second opposite direction said drive spring permitting said drive shaft to rotate independently of said idle shaft.

Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. The specification and drawings that follow describe and disclose some of the specific forms of the invention.

Figure 1:
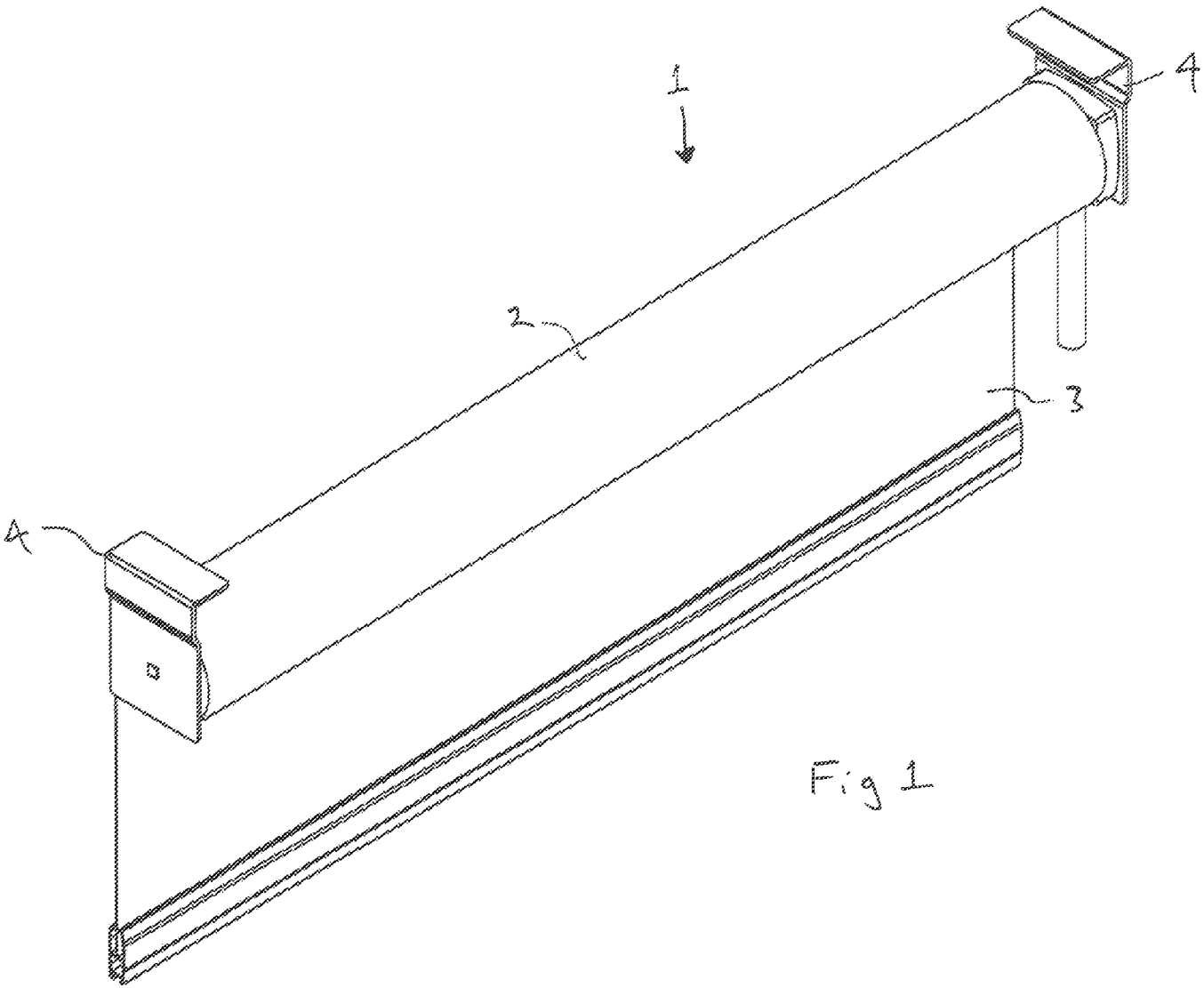
FIG. 1 is an upper side perspective view of a roller blind or roller shade incorporating the clutch of the present invention.
Figure 2:
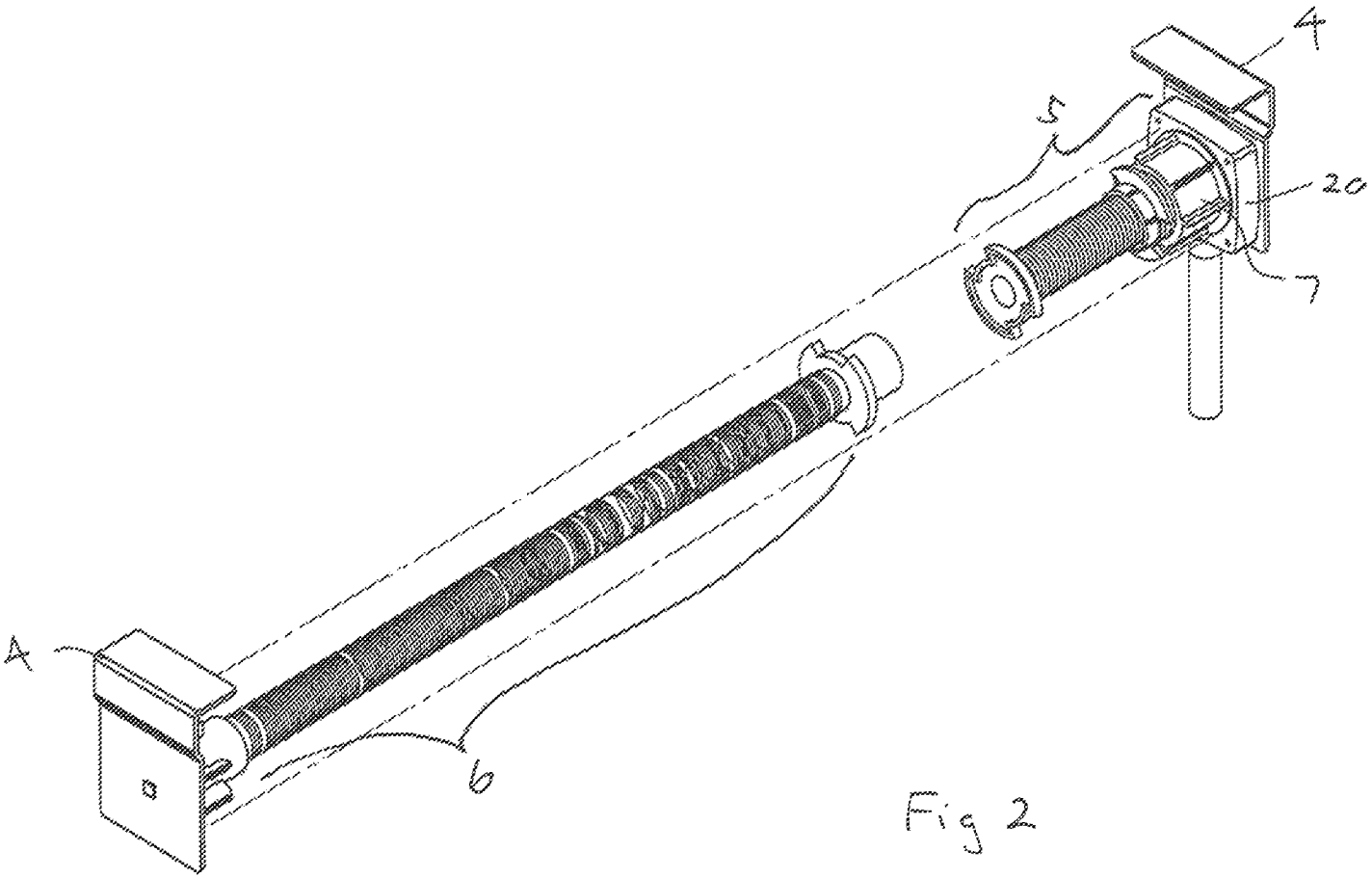
FIG. 2 is a view similar to FIG. 1 wherein the blind material and roller have been removed showing a number of the internal component parts of the roller blind.

The attached drawings show a roller blind or roller shade that incorporates an embodiment of the clutch constructed in accordance with the present invention. In FIG. 1, there is shown a standard roller blind 1 that includes a roller tube 2 (in this instance covered with blind fabric 3) suspended between two end plates 4. The roller tube is rotated by means of a drive mechanism 5. FIG. 2 shows the same roller blind as in FIG. 1, however, the blind fabric and the roller tube have been removed in order to more clearly show some of the internal component parts. In FIG. 2, there is shown a spring assist mechanism 6. From an understanding of the art and an understanding of the present invention, it will be appreciated that spring assist mechanism 6 causes the blind fabric to be automatically rolled back onto the roller tube when desired. FIG. 2 also shows tube housing connectors 7 that fit into the ends of the roller tube in order to secure it in place between end plates 4. In FIG. 2, the drive mechanism 5 is depicted as being positioned at the right hand end of the roller tube, however, it will be appreciated that the drive mechanism could also be located at the opposite end.

Figure 3:
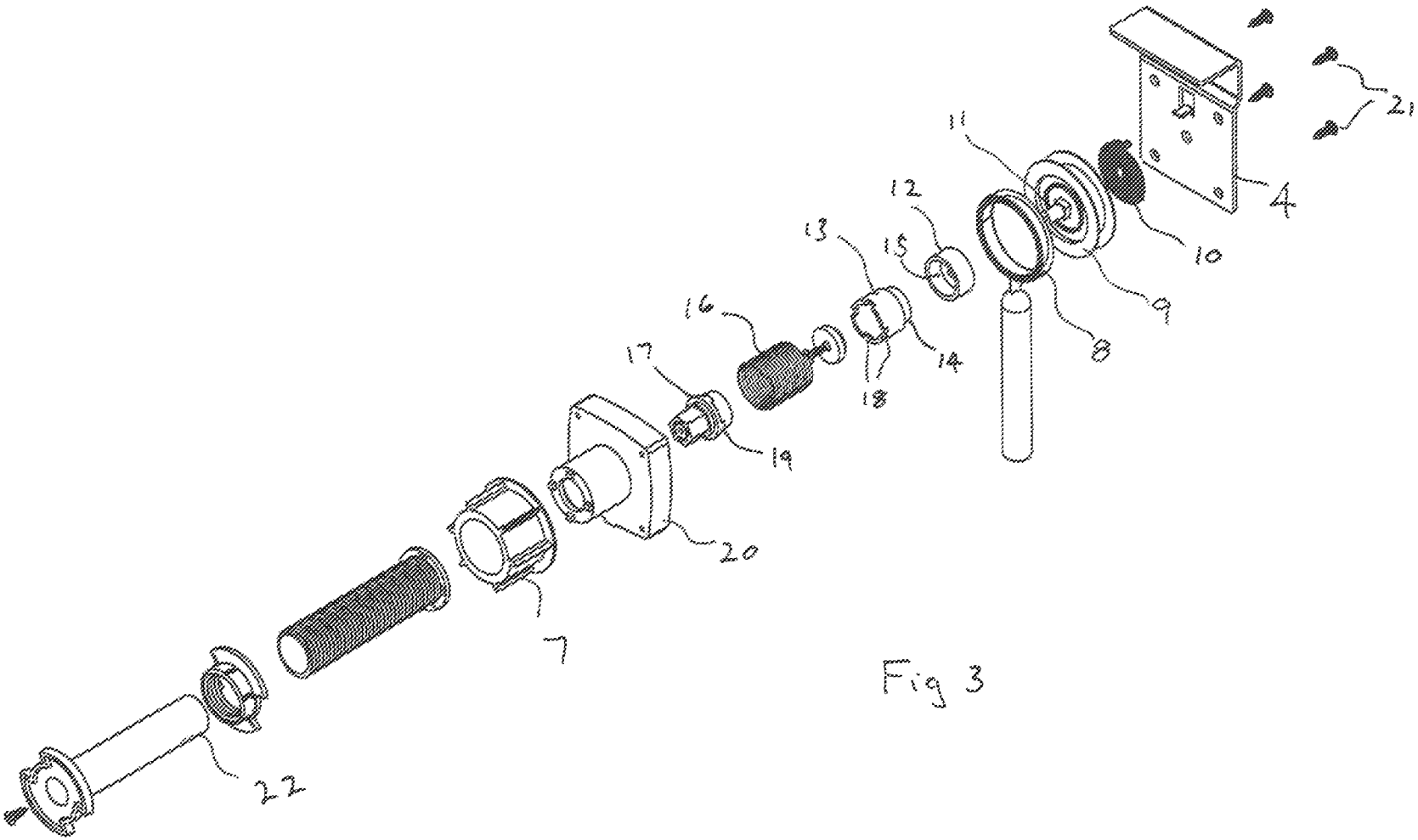
FIG. 3 is an exploded view of the clutch and drive mechanism shown at the right hand end of FIG. 2.
Figure 4:
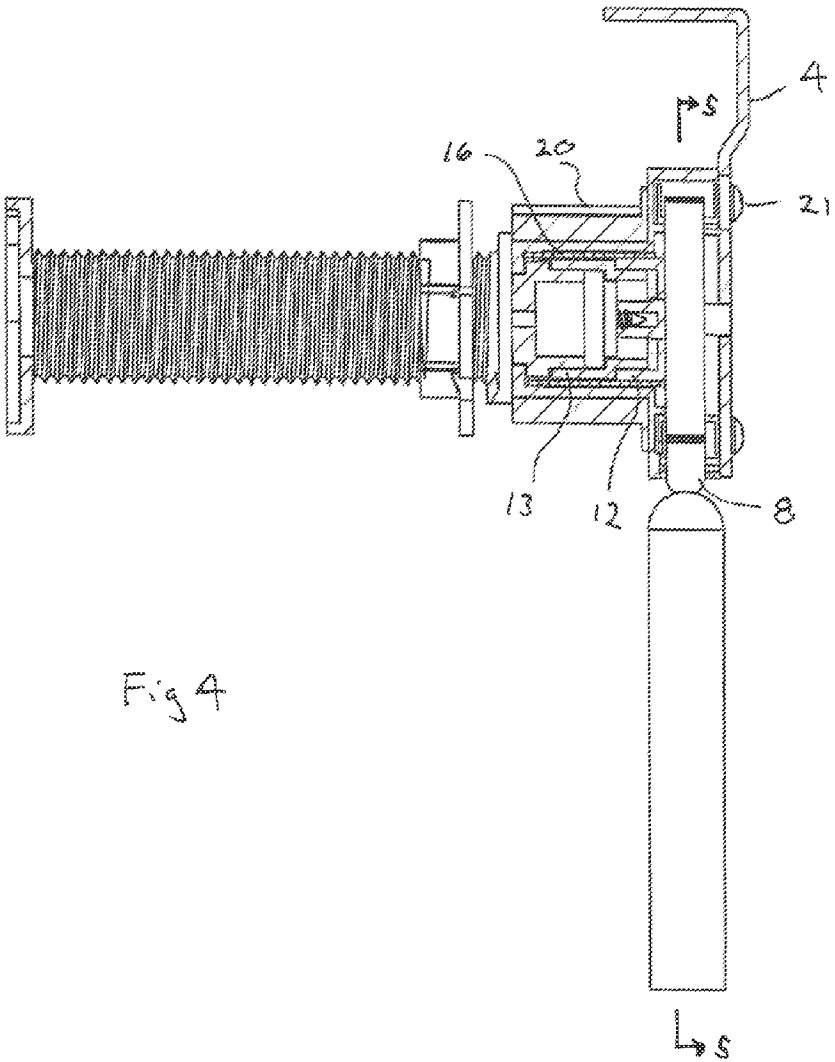
FIG. 4 is a side sectional view of the clutch and drive mechanism shown in FIG. 2.
Figure 5:
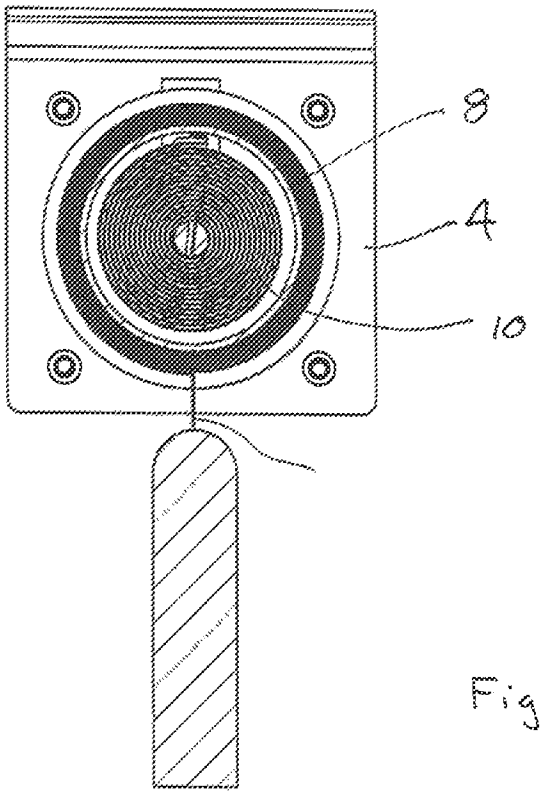
FIG. 5 is a sectional view taken along the line 5-5 of FIG. 4.
Figure 7:
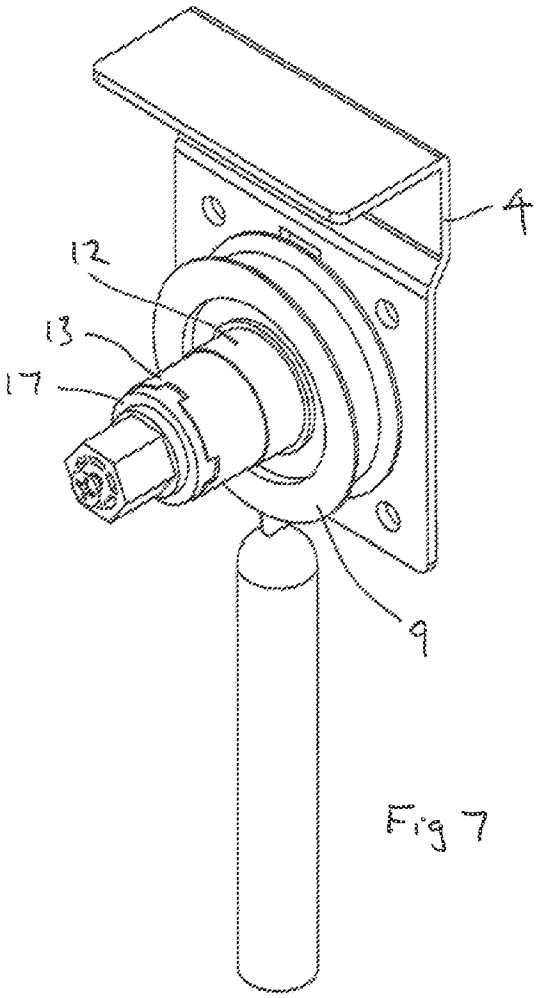
FIG. 7 is a view similar to FIG. 6 wherein the drive spring has been removed.
Figure 6:
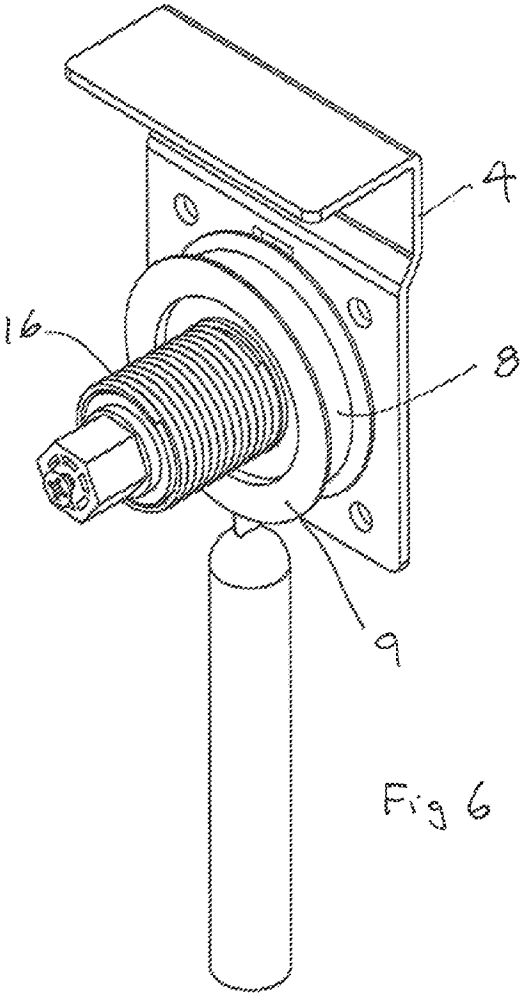
FIG. 6 is an upper side perspective view of an embodiment of the clutch wherein the clutch housing has been removed.
Figure 8:
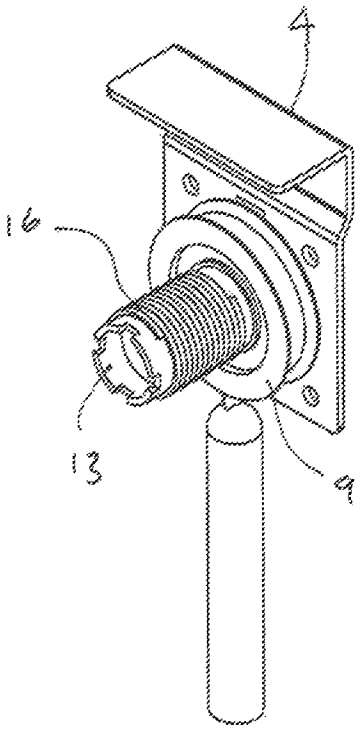
FIG. 8 is a view similar to FIG. 7 wherein the drive member has been removed.
Figure 9:
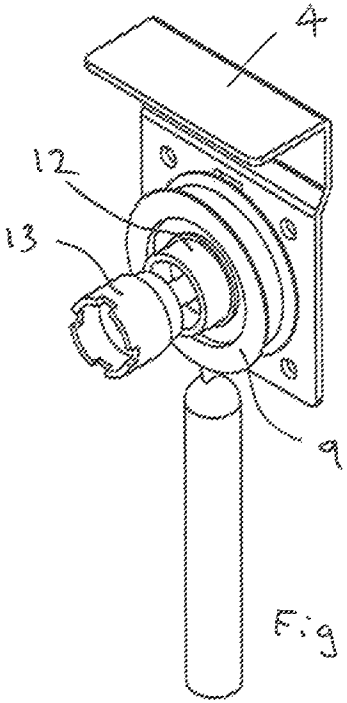
FIG. 9 is a view similar to FIG. 8 wherein both the drive member and the drive spring have been removed.

In FIG. 3 there is shown an exploded view of drive mechanism 5. The drive mechanism in this embodiment is generally referred to as a retractable drive as it includes a cord, strap or ribbon 8 that is received upon a drum 9. Other forms of drive mechanisms could be used. In drive mechanism 5 the cord, strap or ribbon can be pulled downwardly in order to impart rotational movement to the drive mechanism. When the tension on the cord, strap or ribbon is released it is retracted back onto drum 9 so that it does not hang downwardly from the roller blind. It will be appreciated that there are a number of different retractable drives which could be utilized in roller blind 1. In the attached drawings, the retractable drive is a relatively simplified structure that essentially comprises drum 9, cord, strap or ribbon 8 and a retraction spring 10. Retraction spring 10 will have one end secured to end plate 4 to allow the spring to bias drum 8 to its retracted position after the drum has been rotated through pulling the cord, strap or ribbon downwardly from the roller blind.

As shown in FIG. 3, drum 9 includes a drive coupling 11 that is operatively associated with a drive shaft 12. In the particular embodiment that is shown, drive coupling 11 has square cross-sectional configuration with drive shaft 12 being generally cylindrical, but having a square shaped aperture in one end such that the drive shaft can be received over the drive coupling. In this manner, rotation of drum 9 and drive coupling 11 in either direction will impart a corresponding rotation to drive shaft 12.

Referring again to FIG. 3, there is shown an idle shaft 13 that is releasably coupled to drive shaft 12 such that at different times the idle and drive shafts will rotate together, while at other times they will be permitted to rotate independently. In this embodiment the idle shaft is generally cylindrical in nature, but includes at one end a reduced diameter portion 14 that is received within the hollow interior 15 of drive shaft 12. The dimensions of reduced diameter portion 14 and hollow interior 15 are such that the idle shaft can freely rotate independently of the drive shaft while both the drive shaft and the idle shaft remain coaxial. The operative connection between the drive shaft and the idle shaft is accomplished through the use of a drive spring 16. Drive spring 16 is operatively associated with both the idle shaft and the drive shaft such that rotation of the drive shaft in a first direction causes the drive spring to rotate the idle shaft while rotation of the drive shaft in the opposite direction allows the drive and idle shafts to rotate independently. In the embodiment of the invention shown the drive spring is a coil spring that is coaxial with the idle and drive shafts and that is received at least partially over the exterior of both the drive shaft and the idle shaft.

The function of the drive spring will now be discussed in more detail and is based on the understanding that fixing one end of a coil spring and then applying a rotational force to the opposite end in the direction of the winding of the coils will have a tendency to cause the diameter of the spring to be reduced, and that an opposite rotational force will have a tendency to cause the diameter of the spring to increase. Similarly, applying a rotational force to both ends of a spring, where each force is in the direction of the windings of the coils, will have a tendency to cause the diameter of the spring to be reduced while opposite rotational forces will have a tendency to cause the diameter of the spring to increase. For purposes of illustration, in the following discussion rotation that would result in the removal of blind fabric from the roller tube in FIG. 1 will be considered to be counter clockwise rotation or in a counter clockwise direction, and rotation that would result in blind fabric being rolled back onto the roller tube will be considered to be clockwise rotation or in a clockwise direction.

The ability for the drive spring to perform as intended is to a large degree a function of the diameter of the drive spring (when compared to the exterior diameter of the drive and idle shafts) and the direction of winding of the spring coils. In the embodiment shown in the attached drawings the interior diameter of the drive spring (when at rest and not under rotational load) is slightly greater than the outside diameter of the idle shaft and the spring coils are wound in a counter clockwise direction (see FIG. 11). It will be understood that depending on a wide variety of different factors (including the material from which the drive spring and idle shaft are made, the frictional interaction between the various parts, the presence of a lubricant, etc.) the dimensional difference between the interior of the drive spring and the exterior of the idle shaft could vary. It should also be noted that in the described embodiment the exterior dimension of the drive shaft will typically be slightly larger than the interior dimension of the drive spring (when at rest and not under rotational load) such that the interior surface of the drive spring will tend to fit relatively snugly about the exterior of the drive shaft. In this manner, rotation of the drive shaft in a first direction (counter clockwise in the attached figures and as defined above) will result in a corresponding rotation of the drive spring.

Figure 10:
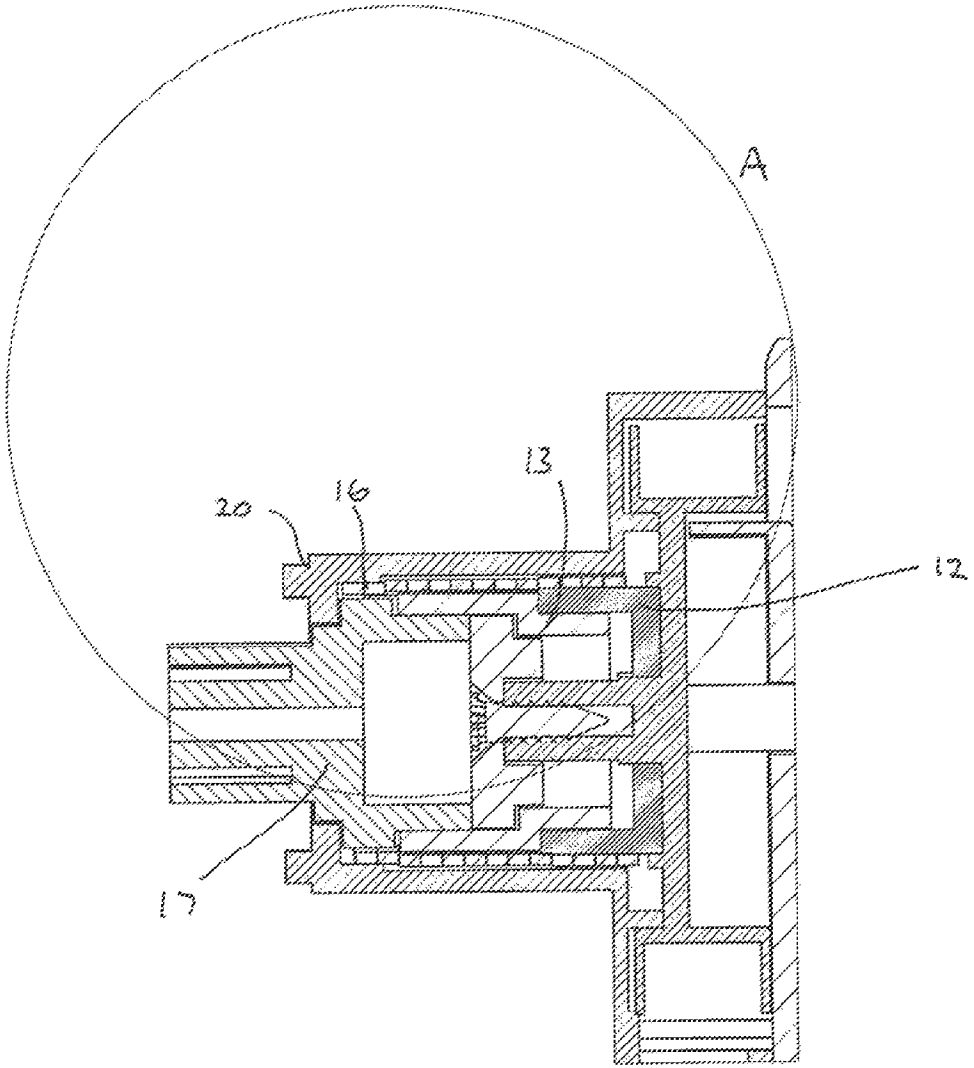
FIG. 10 is an enlarged sectional view through a portion of the clutch and drive mechanism presenting further details of the drive spring.
Figure 11:
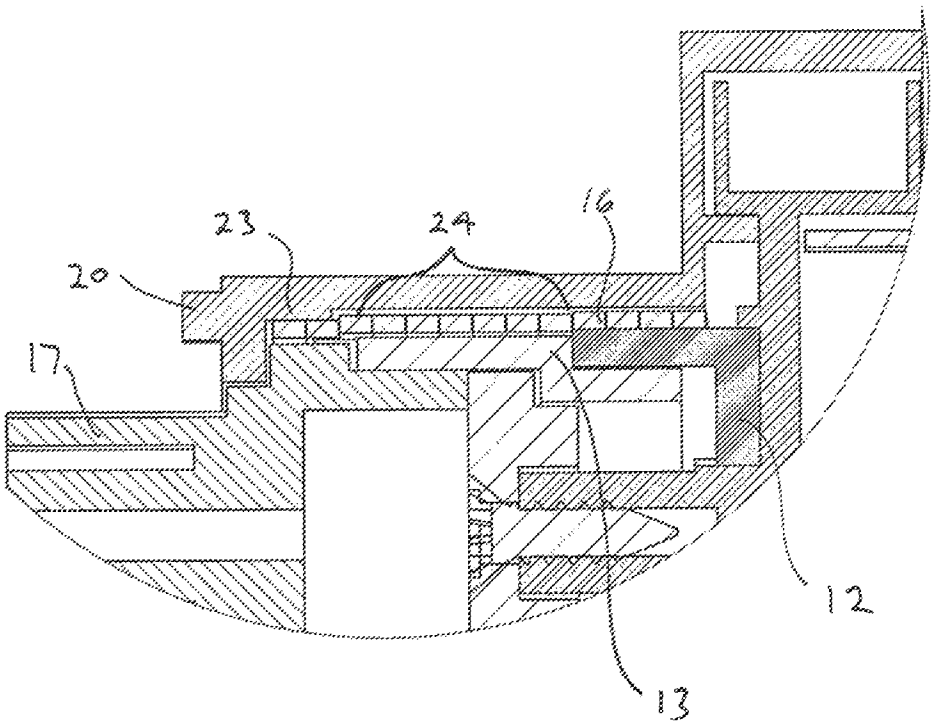
FIG. 11 is an enlarged detail view of section A shown in FIG. 10.
Figure 12:
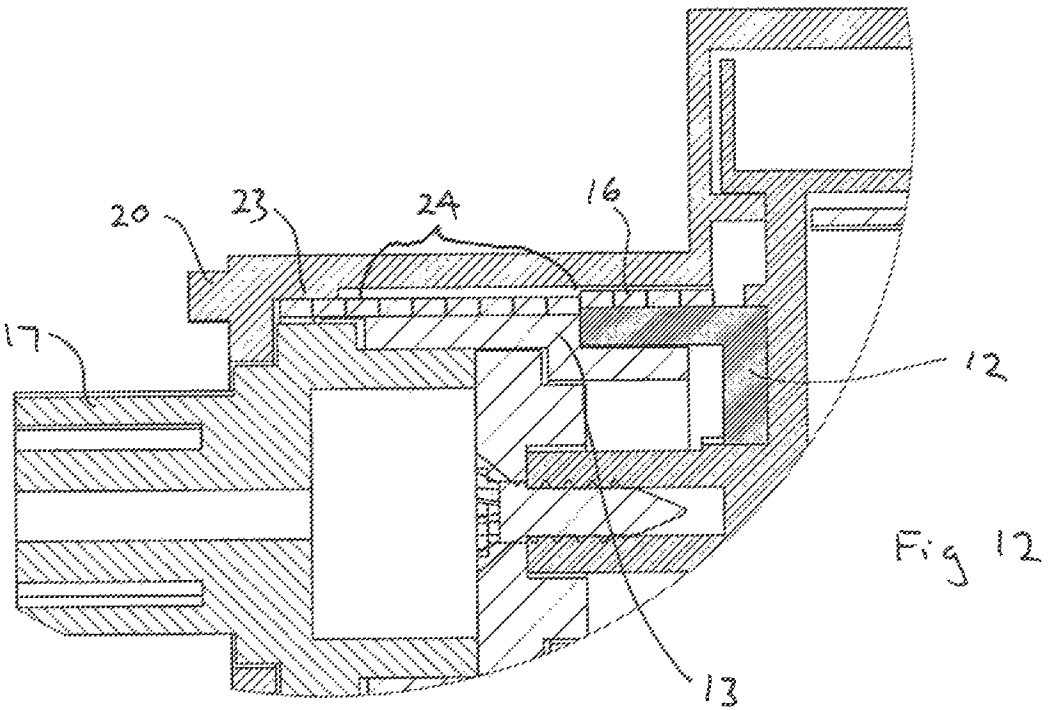
FIG. 12 is a view similar to that shown in FIG. 11 wherein the diameter of the drive spring has been reduced such that the drive spring engages the idle shaft.

With specific reference to FIGS. 10, 11 and 12, it will be noted that the outer end of the clutch housing 20 has an interior portion 23 with a reduced diameter that is preferably less than the exterior diameter of drive spring 16 when the spring is at rest and not under rotational load. Accordingly, as shown in FIGS. 10 through 12, when the drive spring is inserted into reduced diameter portion 23, the exterior surface of the spring will frictionally engage the interior surface of the housing. In this manner, when the drive shaft is rotated in its first direction (counter clockwise as defined above) the end of the spring inserted into reduced diameter portion 23 will tend to be held relatively stationary as the drive shaft rotates the opposite end of the spring. This will cause the spring to be reduced in diameter and to be more tightly held about the drive shaft. As the diameter of the spring decreases the diameter of mid-portion 24 of the spring (that is initially adjacent to but not in contact with idle shaft 13) will be reduced to the point where mid-portion 24 eventually contacts the exterior surface of the idle shaft. When the spring is engaged about the outer surface of the idle shaft the drive shaft will effectively be connected to the idle shaft through the drive spring. The weight and inertia of the idle shaft (and the roller tube and blind fabric) is such that the continued rotation of the drive shaft will tend to cause the spring to more firmly grip both the drive and idle shafts. The described structure will thus permit the drive shaft, the drive spring and the idle shaft to rotate, essentially in unison (see FIG. 12).

Similarly, when the drive shaft is rotated in its second or opposite direction (clockwise as defined above) the direction of the winding of the spring coils will cause the diameter of the spring to increase to the point where it no longer contacts the idle shaft. Further rotation of the drive shaft in a clockwise direction will tend to "open" the spring, causing the drive shaft to overrun the spring and permitting the drive shaft to rotate independently within the interior of the spring so that the drive shaft is free to rotate independently from the idle shaft. Thus, the described structure presents a mechanism to releasably couple the drive and idle shaft together in order to, in one instance, permit the drive shaft to rotate the idle shaft, while in another instance permit the drive shaft to rotate independently from the idle shaft. It will be appreciated that the effect of the clockwise rotation of the drive shaft could equally be obtained through a clockwise rotation of the idle shaft through operation of a traditional spring assist that may be present within the roller tube.

As mentioned above, the idle shaft is operatively connected to the roller blind tube. With reference to FIGS. 3 through 9, in the embodiment of the roller blind that is shown there is included a drive member 17 that is connected to idle shaft 13 and that rotates simultaneously therewith. The idle shaft may be fitted with a series of notches 18 into which are received correspondingly shaped tabs 19 that lock the idle shaft and the drive member together so that they rotate simultaneously. Other structures could alternately be used. The end of drive member 17 will extend outwardly through clutch housing 20 (which is, when assembled, secured to end plate 4 through the use of screws 21) and is received within tube engaging member 22 to effectively rotationally lock the idle shaft, the drive member and the roller tube together.

From an understanding of the above described structure it will be appreciated that with blind fabric 3 received fully on roller tube 2, the application of a tensile load to cord, strap or ribbon 8 will cause the rotation of drum 9 and drive shaft 12. That rotation will effectively result in a tightening of drive spring 16 about idle shaft 13 until such point as the drive spring grips the idle shaft causing the idle shaft to be rotated, generally in unison with the drive shaft. Rotation of the idle shaft results in a corresponding rotation of drive member 17, tube engaging member 22 and roller tube 2. As the roller tube rotates blind fabric 3 will unwind from the roller tube. When the tension on cord, strap or ribbon 8 is released retraction spring 10 will cause drum 9 to rotate in an opposite direction (i.e. clockwise in FIG. 2) which will have the dual purpose of causing the cord, strap or ribbon to be rewound onto the drum, and to also rotate the drive shaft in a second or opposite direction thereby causing a relaxing of the drive spring about the exterior surface of the idle shaft, and permitting the drive shaft and idle shaft to rotate independently. At that point spring assist 6 will retain the roller tube in position such that the drive shaft will rotate in its opposite direction but no corresponding rotation will occur with respect to the roller tube. The end result will be that the blind fabric will remain in its extended or unwound position and the clutch mechanism will allow the drive and roller shafts to rotate independently so that the cord, strap or ribbon can be fully rewound upon the drum. When it is desired to rewind the blind fabric back upon the roller tube, the fabric can be pulled downwardly by a slight amount to disengage the spring assist (as is common in existing spring assist devices) after which the spring assist will cause the roller tube to rotate and wind the fabric back onto its exterior.

It is to be understood that what has been described are the preferred embodiments of the invention. The scope of the claims should not be limited by the preferred embodiments set forth above, but should be given the broadest interpretation consistent with the description as a whole.

I claim:

1. A clutch for a roller blind, the roller blind having a roller tube for receiving blind fabric, the clutch comprising:

a drive shaft operatively connected to a drive mechanism, the drive mechanism imparting rotational movement to said drive shaft;

an idle shaft operatively connected to the roller tube of the roller blind such that rotation of said idle shaft causes rotation of the roller tube, the idle shaft having an external diameter; and a drive spring, said drive spring in the form of a coil spring having an interior diameter and received at least partially over an exterior portion of each of said drive shaft and said idle shaft, the drive spring being engaged with the drive shaft only via a frictional engagement, wherein rotation of said drive shaft in a first direction causes the internal diameter of said drive spring to be reduced causing said drive spring to grip and impart rotational movement to said idle shaft thereby causing rotation of the roller tube, when said drive shaft is rotated in a second opposite direction the internal diameter of said drive spring increasing and permitting said drive shaft to rotate independently of said idle shaft and said drive spring.

2. The clutch as claimed in claim 1 wherein said drive spring, said drive shaft and said idle shaft are generally cylindrical and generally coaxial.

3. The clutch as claimed in claim 2 wherein the interior diameter of said coil spring is greater than the exterior diameter of said idle shaft when said drive spring is at rest and not under rotational load.

4. The clutch as claimed in claim 3 wherein rotation of said drive shaft in said first direction applies a rotational force to said drive spring that causes a reduction in the interior diameter of said drive spring along at least a portion of that aspect of said drive spring that is received over said idle shaft, causing a tightening of at least a portion of said drive spring about the exterior of said idle shaft and causing said drive spring to engage and rotate said idle shaft.

5. The clutch as claimed in claim 4 wherein rotation of said drive shaft in said second direction applies a rotational force to said drive spring that causes an enlargement in the diameter of said drive spring causing a relaxing of said drive spring about the exterior of said idle shaft, permitting said idle shaft to rotate within the interior of said drive spring, and permitting said idle shaft to rotate independently of said drive shaft.

6. The clutch as claimed in claim 5 wherein said first direction of rotation results in an unwinding of blind fabric from the roller tube.

* * * * *

UNITED STATES PATENT AND TRADEMARK OFFICE

CERTIFICATE OF CORRECTION

PATENT NO. : 8,844,605 B2
APPLICATION NO. : 13/612479
DATED : September 30, 2014
INVENTOR(S) : Philip Ng It is certified that error appears in the above-identified patent and that said Letters Patent is hereby corrected as shown below:

On the Title page:

(74) Attorney, Agent, or Firm:

please change "Honigan" to --Honigman--

Signed and Sealed this
Thirteenth Day of January, 2015

Michelle K. Lee

Michelle K. Lee
*Deputy Director of the United States Patent and Trademark Office*